US007021023B2

(12) United States Patent
Rood, Jr.

(10) Patent No.: US 7,021,023 B2
(45) Date of Patent: Apr. 4, 2006

(54) STANDING SEAM ROOF AND METHOD OF MANUFACTURING SAME

(76) Inventor: Rodney Rood, Jr., c/o Northeast Roofing Co., Inc., P.O. Box 104, South Ryegate, VT (US) 05069

( * ) Notice: Subject to any disclaimer, the term of this patent is extended or adjusted under 35 U.S.C. 154(b) by 77 days.

(21) Appl. No.: 10/369,105

(22) Filed: Feb. 20, 2003

(65) Prior Publication Data

US 2004/0163351 A1 Aug. 26, 2004

(51) Int. Cl.
*E04B 1/00* (2006.01)

(52) U.S. Cl. ..... 52/748.1; 52/588.1

(58) Field of Classification Search ..... 52/588.1, 52/741.1, 741.4, 746.11, 748.1, 528; 29/505, 29/428; 403/205, 345
See application file for complete search history.

(56) References Cited

U.S. PATENT DOCUMENTS

| | | | | | |
|---|---|---|---|---|---|
| 451,550 | A | * | 5/1891 | Bayer | 52/528 |
| 1,292,960 | A | * | 1/1919 | Owens | 52/528 |
| 1,796,015 | A | * | 3/1931 | Francis et al. | 29/505 |
| 3,353,319 | A | * | 11/1967 | Gronlund | 52/520 |
| 3,474,585 | A | * | 10/1969 | Foster | 52/394 |
| 3,511,011 | A | * | 5/1970 | Straus | 52/478 |
| 3,862,490 | A | * | 1/1975 | Tsuneishi et al. | 29/505 |
| 3,942,232 | A | * | 3/1976 | McGuire | 29/890.14 |
| 4,155,206 | A | * | 5/1979 | Player | 52/200 |
| 4,223,503 | A | * | 9/1980 | Hague | 52/478 |
| 5,094,043 | A | * | 3/1992 | Ristow | 52/63 |
| 5,259,166 | A | * | 11/1993 | Carey et al. | 52/749.12 |
| 5,715,640 | A | | 2/1998 | Haddock | |
| 5,737,894 | A | | 4/1998 | Simpson et al. | |
| 6,088,983 | A | * | 7/2000 | Applebee | 52/282.1 |
| 6,164,033 | A | | 12/2000 | Haddock | |
| 6,499,259 | B1 | | 12/2002 | Hockman | |
| 6,834,466 | B1 | | 12/2004 | Trevorrow et al. | |

OTHER PUBLICATIONS

Try-Lock Roofing Company, Copper Sales, Inc., Una-Clad, Metal Standing Seam Roofing, UC-4 "No-Clip" Architectural Series Roofing System, Sep. 17, 2002, pp. 1-2.

* cited by examiner

*Primary Examiner*—Milton Nelson, Jr.
(74) *Attorney, Agent, or Firm*—William E. Jackson; Stites & Harbison PLLC

(57) ABSTRACT

A method of forming a continuous joint between and along the upwardly projecting side walls of a pair of channel-shaped panels each having a central web with first and second side edges. The first side wall of one panel initially comprises first and second vertical legs and a nail strip connected to the bottom of said first vertical leg. The opposing side wall of the other panel is a vertical leg with an upper, inverted U-shaped channel. The method comprises: a) locating a first panel with said nail strip to overlay a roof support surface, b) driving fasteners through the nail strip into the roof support surface, c) placing the second side wall of a second roof panel into engagement with the first side wall wherein the inverted U-shaped channel is interfitted over the first side wall, and d) deforming the interfitted side walls to form a deformed standing seam.

4 Claims, 3 Drawing Sheets

STANDING SEAM ROOF AND METHOD OF MANUFACTURING SAME

FIELD OF THE INVENTION

The present invention generally relates to standing seam metal roofs and, more particularly, to an improved roof profile for the attachment and interconnection of adjacent field-seamed metal roof panels.

BACKGROUND OF THE INVENTION

With the increased use of sheet metal panels in building construction, there has been an increased need to address ways in which the traditional standing seam roof can be manufactured. For example, the typical standing seam roof utilizes adjacent metal panels which are affixed at their edges and utilize separate attachment clips spaced along the standing seam by which the standing seam is attached to the roof underlayment whether it be in the form of rafters, plywood or other conventional underlayment. The use of such attachment clips involves several problems. First, the use of clips means that the fabricator has additional parts to manipulate and utilize when manufacturing a standing seam roof on a structure. Furthermore, the use of and manipulation of such clips requires additional labor steps thereby increasing the labor costs of attaching a standing seam roof assembly. Moreover, in the case of dissimilar metals between the clips and the standing seam roofing material (e.g., copper versus iron-based clips), there is a potential problem of galvanic reaction between the dissimilar metals. In part, this problem is resolved by the use of relatively expensive stainless steel clips in order to reduce the potential or galvanic corrosion.

Moreover, the use of clips leads to distortion of the seamed vertical leg of the standing seam roof where the overlapped edges of the roofing panels and the attachment clip have been seamed into the final standing seam configuration.

Accordingly, it is highly desirable to make a more efficient standing seam roof structure and method compared to such prior art which does not require the use of attachment clips and the attendant drawbacks. Thus, the elimination of such attachment clips has the potential to lead to faster standing seam roof application, more cost effective application and more durable application with a more pleasant final appearance than the prior art.

The prior art connector clip generally discussed above is exemplified by U.S. Pat. No. 3,312,028 to Schroyer. In particular, the '028 patent is an example of the use of a standing seam roof formed of interlocked channel sections which utilize a connector to tie down a series of connected panels upon a plurality of underlying rafters. The prior art connector clip is fabricated of a thin metal strip, bent to provide an intermediate body and an open curl at one end thereof and a foot bent at right angles from the other end. The foot is adapted to be secured to a rafter by a nail driven through a nail hole in the foot. The body of the connector clip is adapted to be sandwiched between adjacent side flanges of attached panels and the curl is adapted to be locked between the coupled bead and sleeve of the panels. As best seen in FIG. 9 of the '028 patent, the connector clip is nailed into the underlayment rafter and adjacent rafters have similar connector clips and nails to securely hold the roof structure to the rafters.

The prior art also includes a self locking roofing system wherein a nail strip is incorporated into one edge of the self locking panel. Such self locking roof systems are available from Copper Sales, Inc. under the trademark UNA-CLAD, model UC-4 "No Clip" Architectural Series Roofing System. This system does not involve a field-seamed standing seam connection wherein adjacent panels are deformed at the work location to form a roof as disclosed herein.

SUMMARY OF THE INVENTION

The present invention is generally directed toward an improvement in the method of mounting a field-seamed metal standing seam roof.

In one aspect of the present invention, the combination of a plurality of spaced supporting surfaces and a series of rigid interlocked metal panels is involved. The combination utilizes the spaced supporting surfaces of a building structure (e.g., rafters, plywood sheathing). The plurality of spaced supporting surfaces are spanned by a series of rigid, interlocked metal panels affixed to and enclosing the space between the spaced supporting surfaces. Each of the metal panels has a central web with first and second side edges. Furthermore, each metal panel has a side wall connected to and projecting upwardly from each side edge of the central web. According to the present invention, a first side wall comprises a vertical leg and a first base member connected to the upper end of the first vertical leg and having an outer edge located over the first side edge. In addition, a nail strip flange is provided in the same plane as the central web and is connected to the bottom of the first vertical leg. The nail strip flange may define a plurality of longitudinally spaced nail holes which are round or elongated slots. The first side wall further comprises a second vertical leg contiguous to the first vertical leg, the second vertical leg being connected to a base member having an edge located over said first base member. The first base member and the second base member are connected at their free edges.

Each metal panel also has a second side wall comprising a third vertical leg with an upper, inverted U-shaped channel. The U-shaped channel is formed from a base member having one edge connected to the upper end of the third vertical leg and another edge extending outwardly beyond the second side edge of the metal panel and having a vertical lip member connected to the free edge. The first and second side walls of adjacent metal panels are dimensioned so that the inverted U-shaped channel on one side edge fits on and interlocks with the base and first and second vertical legs of the first side wall. The U-shape interlock is typical but the invention is not limited to a U-shaped interlock. Any interlock requiring field-seaming is anticipated. Further, the side wall configuration increases the structural strength of each panel which leads to easier handling in the field, etc.

According to a further aspect of the invention, the nail strip flange is provided with slot-shaped nail holes to allow for the expansion and contraction of the metal panel.

According to a further aspect of the present invention, the metal panels have side walls which can be of a height and shape as to be classified as structural and self-supporting profile or as an architectural profile which requires installation over a solid substrate.

According to another aspect of the present invention, the interlocked metal panels are manufactured of any metal deemed suitable for roofing applications, such as sheet steel, copper sheet or aluminum sheet.

According to the present invention, a method of coupling together and simultaneously forming a continuous rigid waterproof joint between the adjoining and upwardly projecting side walls of a pair of channel-shaped panels is provided. According to the method, the channel-shaped panels are formed of a central web having first and second side edges. The joint between adjacent panels extends along the entire length of the panels. The first side wall of one panel comprises a vertical leg and first base member connected to the upper end of the first vertical leg and having an outer edge located over the first side edge. Additionally, the first side wall comprises a nail strip located in the same plane as the web and connected to the bottom of the first vertical leg. The nail strip may be plain or define a plurality of nail holes along the longitudinal length of the panels. The holes, if used, may be elongated slots. Further, the first side wall comprises a second vertical leg contiguous to the first vertical leg. The second vertical leg is connected to a second base member having an edge located over the first base member. The free edges of the first and second base members are connected together.

According to the method of the present invention, the opposing side wall of the other adjacent panel is comprised of a vertical leg with an upper, inverted U-shaped channel formed by a base member having an edge extending outwardly beyond the second side edge of the panel. Further, the edge of the base member has a vertical lip connected to it extending downwardly toward the surface of the web. The present invention comprises the steps of locating a panel with said nail strip positioned in an orientation to overlay a roof supporting surface into which nails, fasteners or staples may be driven. Next, it comprises the step of driving fasteners through the nail strip and into the roof supporting structure to secure the first side wall to the roof underlayment. The next step involves placing the side wall of an adjacent roof panel into engagement with the first side wall of the first panel wherein the inverted U-shaped channel of the second side wall is situated over the base and first and second vertical legs of the first side wall. After this step, the next step involves placing a pressure-applying means to the side walls and effecting a seaming deformation thereof whereby said lip is deformed to a position laying directing beneath the first base member on the first vertical leg. An additional step of the present invention may comprise further deforming the interfitted side walls to form a deformed seam wherein the base of the first leg is bent toward the surface of the central web and is thereby positioned substantially parallel to the first and second vertical legs.

DESCRIPTION OF THE PREFERRED EMBODIMENTS

Figure 1:
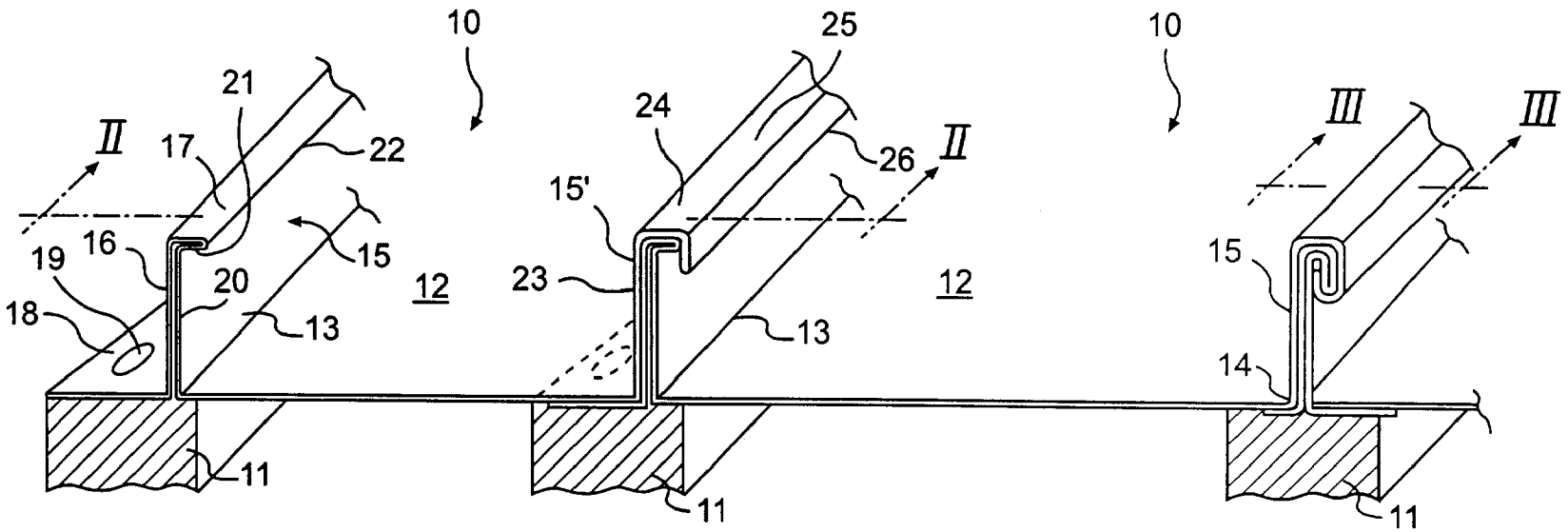
FIG. 1 is an orthogonal view illustrating a plurality of spaced supporting members and series of rigid interlocked metal panels with side edges according to the present invention.

Turning to FIG. 1, an orthogonal view of one embodiment of the present invention is illustrated. FIG. 1 depicts a plurality of rigid interlocked metal panels 10 affixed to and enclosing the space between spaced supporting members 11 of a building structure. Each metal panel 10 has a central web 12 with first and second side edges 13 and 14, respectively. Each side edge has a side wall 15 and 15' connected to and projecting upwardly from the edge of the central web 12.

In the left-hand portion of FIG. 1, there is provided a first side wall 15. The side wall 15 comprises a first vertical leg 16 and a first base member 17 connected to the upper end of the first vertical leg 16. In turn, the first base member has an outer edge located over the first side edge 13. Additionally, a nail strip 18 located in the same plane as the central web 12 is connected to the bottom of the first vertical leg 16. As indicated in FIG. 1, the nail strip may define a plurality of longitudinally spaced nail holes 19 with an elongated nail hole configuration. Alternatively, the nail strip may be plain and, in use, fasteners are driven through the nail strip by conventional means such as a nail gun.

Further referring to FIG. 1, the first side wall 15 further comprises a second vertical leg 20 extending upwardly from the first side edge of metal panel 10. Further, the vertical leg 20 is connected to a second base member 21 which has an edge located under the first base member 17. The first and second base members 17 and 21, respectively, have a connection at their free edge at 22.

A further reference to FIG. 1, the second side wall 15' comprises a third vertical leg 23 with an upper inverted U-shaped channel 24 formed from a base member 25 which has one edge connected to the upper end of the third vertical leg 23 and another edge extending outwardly beyond the second side edge 14. In addition, the outer edge of the base member 25 has a vertical lip member 26 connected thereto. As depicted in FIG. 1, the first and second side walls are dimensioned so that the inverted, U-shaped channel 24 on one edge fits on and interlocks with the base and first and second vertical legs of the side wall of an adjacent metal panel.

Figure 2:
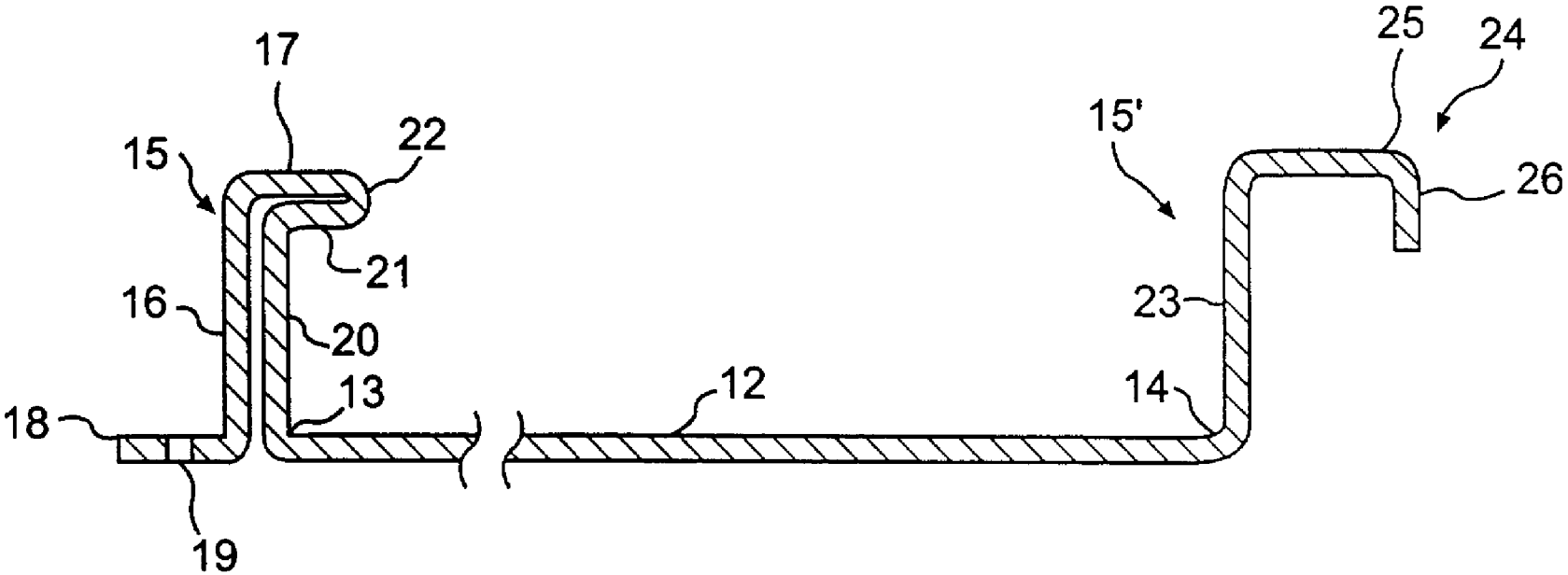
FIG. 2 is a partial cross sectional view taken along II—II of FIG. 1 of a metal panel according to the present invention prior to being deformed once attached to a roof underlayment.

FIG. 2 is an enlarged partial cross section taken along line II—II in FIG. 1. FIG. 2 has like numbers applied to the cross section members or elements already described in connection with FIG. 1. In particular, FIG. 2 depicts a central web 12 having a first edge 13 and a second edge 14. These edges are provided with side walls 15 and 15' connected to and projecting upwardly from respective side edges of the central web 12. In the left-hand portion of FIG. 2, a first side wall 15 is depicted. It comprises a first vertical leg 16 and a first base member 17 connected to the upper end of the first vertical leg 16. The first base member has an edge located over the first side edge 13. Also, a nail strip 18 is located in the same plane as the central web 12 and is connected to the bottom of the first vertical leg 16. The nail strip may define a plurality of longitudinally spaced nail holes depicted with a cross section of one nail hole being depicted as 19 in FIG. 2. Further, the first side wall 15 includes a second vertical leg 20 contiguous to the first vertical leg 16. The second vertical leg 20 is connected to a base member 21 which is connected to the upper end of the second vertical leg 20. The base member 21 has a free edge located under the first base member 17 connected to the upper end of first vertical leg 16. Also, the inward facing edges of the first and second base members are connected at location 22. As depicted in FIG. 2, connection 22 is merely a fold, bend or crease formed by bending the sheet metal of the metal panel to form a U-shaped ledge structure overlying location 13, the one edge of metal panel 10.

Further referring to FIG. 2, the second side wall 15' comprises a third vertical leg 23 with an upper, inverted U-shaped channel 24 formed from a base member 25 which has one edge connected to the upper end of the third vertical leg 23 and another edge extending outwardly beyond the location of second side edge 14 of the metal panel. The outer edge of base member 25 has a vertical lip member 26 connected thereto and extending downwardly toward the upper surface of web 12.

It should be apparent from the description in the specification to this point that the side walls 15 and 15' are dimensioned so that the inverted, U-shaped channel 24 on one side edge of web 12 fits on and interlocks with the base and first and second vertical legs forming the side wall of an adjacent metal panel.

Figure 3:
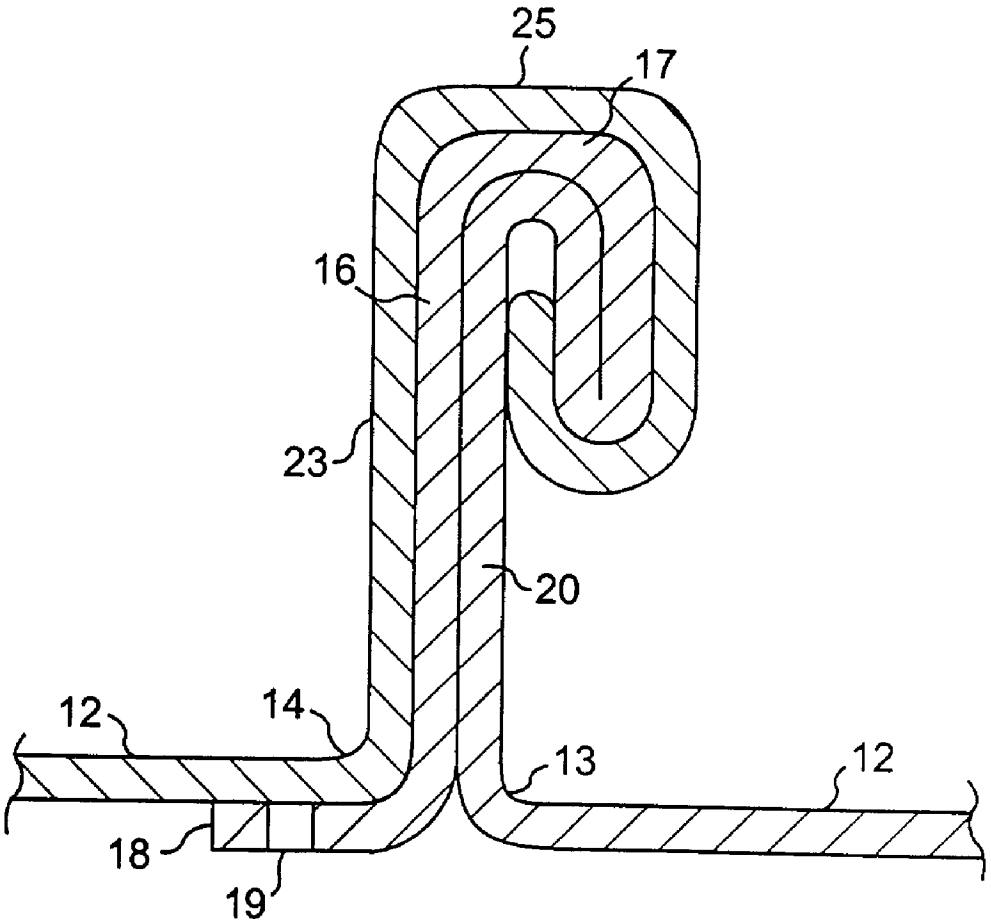
FIG. 3 is a blown up partial cross sectional view taken along III—III of FIG. 1 illustrating the interlocking relationship between the side walls of adjacent metal roof panels and the position of the nail strip at the bottom of the first vertical leg which forms part of one side wall.

FIG. 3 is a schematic partial cross sectional view, taken along line III—III of FIG. 1, of a deformed standing seam utilizing the deformed first and second side walls according to one embodiment of the present invention. The cross section is taken along lines 3—3 in FIG. 1. The numerals in FIG. 3 correspond to the parts numbered in FIGS. 1 and 2 as described above. It will be apparent from FIG. 3 that no separate attachment clip or connector is necessary when nailing or otherwise attaching the standing seam roof of the present invention to the roof underlayment. For the detailed reasons given below, this elimination of the attachment clip or connector from the prior art construction, is a significant advance in the art of standing seam roof configurations and methods.

The figures of the drawings depict the present inventive method of coupling together and simultaneously forming a continuous rigid waterproof joint between the adjoining and upwardly projecting side walls of a pair of channel-shaped panels 10 formed of a central web 12 having first and second side edges 13 and 14. The method of coupling the channel-shaped panels 10 includes the following steps: locating a panel 10 with the nail strip 18 positioned in an orientation to overlay a roof supporting surface 11 into which nails or other fasteners may be driven, driving fasteners through the nail strip into the roof supporting structure 11, placing an adjacent roof panel into engagement with the first side wall of the first roof panel wherein the inverted U-shaped channel is interfitted over the base and first and second vertical legs of the first side wall 15, placing pressure-applying or seaming means to the interlocked side walls and effecting deformation thereof whereby the lip 26 is deformed to a position laying directly beneath the first base member 17 which is attached to the top of the first vertical leg 16. There may be further deforming of the interfitted side walls to form a deformed seam wherein the base member of the first leg 16 is bent toward the central web 12 and is thereby positioned substantially parallel to the first and second vertical leg 16 and 20, respectively.

The following are exemplary dimensions wherein the present invention may be used to form a 1½ inch standing seam roof. The invention is not limited to these examples. The central web may vary between about 12 and 24 inches in width. The first vertical leg and the second vertical leg located on one edge of the web have a height of 37 mm. The third vertical leg on the other edge of the panel has a height of 38 mm. Further, the width of the first base member connected to the top of the vertical leg is approximately 10 mm while the width of the base member connected to the third vertical leg is approximately 12 mm. The height of the lip extending downwardly from the outer edge of this said base member may be approximately 10 mm. It should also be, apparent that while a height of 1½ inches for the standing seam is exemplary, the standing seam may also be shorter in height such as one inch or higher in height, depending upon the specific roof design.

As will be apparent to one skilled in the art, the present invention may be utilized on a variety of sheet metal materials having a composition, size and thickness suitable for standing seam roof construction. Exemplary materials include steel, copper and aluminum. Also, as is conventional, the metal sheeting may be coated or bare. Thus, in connection with steel, it may be galvanized and painted and/or painted. Moreover, with respect to copper, it would typically be used in a bare and unpainted and uncoated condition. With respect to aluminum, it could have a coating of paint as well. The thickness of the sheet metal materials used would allow for proper engagement of panels and be acceptable to standard metal roof specifications.

Exemplary thicknesses for steel sheeting for use in the present invention would include those having a thickness of 0.45 mm to 0.61 mm. With respect to exemplary copper sheeting utilized in the present invention, that could be 16–20 ounce material. With respect to aluminum, an exemplary thickness can be approximately 0.68 mm to 0.81 mm. With respect to all of these metal materials, an exemplary width can be approximately 15 to 28 inches.

It should be apparent from the above discussion that the present invention leads to an improved method of manufacture of a field-seamed standing seam roof that requires no separate clips or attachment connectors. Thus, the application of the roofing raw material to the roof and the formation of a final roofing structure can be performed in a faster manner than the prior art that utilizes connector clips. Additionally, this provides the advantage of lowering labor costs as well as material costs involved in application as well as in handling and stocking. The slotted nail holes in accordance with one aspect of the present invention allow for relative movement between the panels and/or the panel and the roof underlayment. Moreover, because of the use of two contiguous first and second vertical legs to form the first side wall of the roof panel of the present invention, substantial strength and stability is added to the panel thereby leading to easier panel handling during the application process. Moreover, the elimination of a separate attachment clip or connector has the advantage of eliminating possible galvanic corrosion created in the prior art devices by the utilization of differing composition metal attachment clips and panel materials. Thus, stainless steel clips found in the prior art used for copper panels are no longer necessary, thereby leading to a reduction in cost. Moreover, since the present invention eliminates the clips or attachment connectors, there are no additional structures to show through on the formed vertical seam formed by the three legs which form the standing seam of the final product according to the present invention.

Although illustrative embodiments of the present invention have been described in detail with reference to the accompanying drawings, it is to be understood that the invention is not limited to those precise embodiments. Various changes or modifications may be effected therein by one skilled in the art without departing from the scope or spirit of the invention. For example, the angles of various disclosed bends can be modified as well as the dimensions of the various portions of the metal panels.

Further, if the nail strip flange is left plain without nail holes, then the nail strip flange can be fastened to the support surface using conventional nailing tools such as a hammer or nail gun and nails.

What is claimed is:

1. A method of coupling together and simultaneously forming a continuous rigid waterproof joint between two adjoining channel-shaped panels, each panel formed of a central web having first and second side edges having respective upwardly projecting side walls, said joint extending along the entire length of said panels, wherein the first side wall of the first panel comprises a first vertical leg and a first base member connected to the upper end of said first vertical leg, said first base member having an outer edge located over said first side edge, a nail strip flange in the same plane as said central web and connected to the bottom of said first vertical leg, a second vertical leg being connected to a second base member, said second base member having an edge located under said first base member and a connection between the edges of said first and said second base members, and wherein one side wall of the second panel is comprised of a vertical leg with an upper, inverted U-shaped channel formed by a base member having an edge extending outwardly beyond said second side edge and a vertical lip, said method comprising the steps of:

a) locating said first panel with said nail strip flange positioned in an orientation to overlay a roof supporting surface into which fasteners may be secured, b) driving fasteners through said nail strip flange into said roof supporting surface, c) placing the side wall of said second panel into engagement with said first side wall wherein said inverted U-shaped channel is situated over said first base member and the first and second vertical legs of said first side wall, and d) placing pressure-applying means against said side walls and effecting a seaming deformation thereof whereby said lip is deformed to a position lying directly beneath said first base member on said first vertical leg.

2. The method of claim 1 comprising the step of further deforming the side walls which are in engagement to form a deformed seam wherein said first base member of said first leg is bent toward said central web and is thereby positioned substantially parallel to said first and second vertical legs.

3. A method of coupling together and simultaneously forming a continuous rigid waterproof joint between two adjoining channel-shaped panels, each panel formed of a central web having first and second side edges having respective upwardly projecting side walls, said joint extending along the entire length of said panels, wherein the first side wall of the first panel comprises a first vertical leg and a first base member connected to the upper end of said first vertical leg, said first base member having an outer edge located over said first side edge, a nail strip flange in the same plane as said central web and connected to the bottom of said first vertical leg, said nail strip flange defining a plurality of nail holes along the longitudinal length of said panels, a second vertical leg being connected to a second base member having an edge located under said first base member and a connection between the edges of said first and said second base members, and wherein one side wall of the second panel is comprised of a vertical leg with an upper, inverted U-shaped channel formed by a base member having an edge extending outwardly beyond said second side edge and a vertical lip, said method comprising the steps of:

a) locating said first panel with said nail strip flange positioned in an orientation to overlay a roof supporting structure into which nails may be driven, b) driving nails through the holes of said nail strip flange into said roof supporting structure, c) placing the side wall of said second panel into engagement with said first side wall wherein said inverted U-shaped channel is situated over said first base member and the first and second vertical legs of said first side wall, and d) placing pressure-applying means to said side walls and effecting a seaming deformation thereof whereby said lip is deformed to a position lying directly beneath said first base member on said first vertical leg.

4. The method of claim 3 comprising the step of further deforming the side walls which are in engagement to form a bead wherein said first base member of said first leg is bent toward said central web and is thereby positioned substantially parallel to said first and said second vertical legs.

* * * * *